United States Patent [19]

Hauser

[11] 4,357,914

[45] Nov. 9, 1982

[54] COOLING SYSTEM FOR INTERNAL COMBUSTION ENGINES

[75] Inventor: Kurt Hauser, Stuttgart, Fed. Rep. of Germany

[73] Assignee: Süddeutsche Kühlerfabrik, Julius Fr. Behr GmbH & Co. KG, Stuttgart, Fed. Rep. of Germany

[21] Appl. No.: 94,154

[22] Filed: Nov. 14, 1979

[30] Foreign Application Priority Data

Nov. 16, 1978 [DE] Fed. Rep. of Germany ..... 2849675

[51] Int. Cl.[3] ..... F01D 7/10

[52] U.S. Cl. ..... 123/41.49; 165/125; 415/53 R; 415/DIG. 1

[58] Field of Search ..... 123/41.49, 41.65, 41.66; 165/51, 125; 415/52, 53 R, DIG. 1, 207; 416/186 R

[56] References Cited

U.S. PATENT DOCUMENTS

| | | | |
|---|---|---|---|
| 914,822 | 3/1909 | Goudard et al. | 165/125 |
| 1,846,379 | 2/1932 | Anderson | 415/53 R |
| 2,566,795 | 9/1951 | Egger | 416/186 |
| 3,265,002 | 8/1966 | Warman | 415/207 |
| 3,698,473 | 10/1972 | Frank et al. | 165/51 |
| 4,086,886 | 5/1978 | Edmaier et al. | 123/41.65 |
| 4,116,171 | 9/1978 | Schulmeister et al. | 415/53 R |
| 4,202,296 | 5/1980 | Nonnenmann et al. | 165/125 |

FOREIGN PATENT DOCUMENTS

| | | | |
|---|---|---|---|
| 1503523 | 8/1969 | Fed. Rep. of Germany | 415/53 |
| 2050265 | 4/1972 | Fed. Rep. of Germany | 415/53 |
| 1576705 | 4/1973 | Fed. Rep. of Germany | 415/53 |
| 2235729 | 1/1974 | Fed. Rep. of Germany | 415/53 |
| 2462475 | 9/1978 | Fed. Rep. of Germany | 415/53 |

*Primary Examiner*—Craig R. Feinberg
*Assistant Examiner*—W. R. Wolfe
*Attorney, Agent, or Firm*—Browdy and Neimark

[57] ABSTRACT

The air flow between the outlet of a centrifugal fan and the inlet of a surrounding annular radiator or heat exchanger for cooling an internal combustion engine is made uniform by rounding the peripheral edges of the fan wheel support discs so as to enlarge the effective outlet channel for the air and to guide the air in the direction of the lateral regions of the radiator. One or more baffle rings controls the short circuit flow to the inlet of the fan as well as the leakage flow at the shaft side of the fan.

6 Claims, 1 Drawing Figure

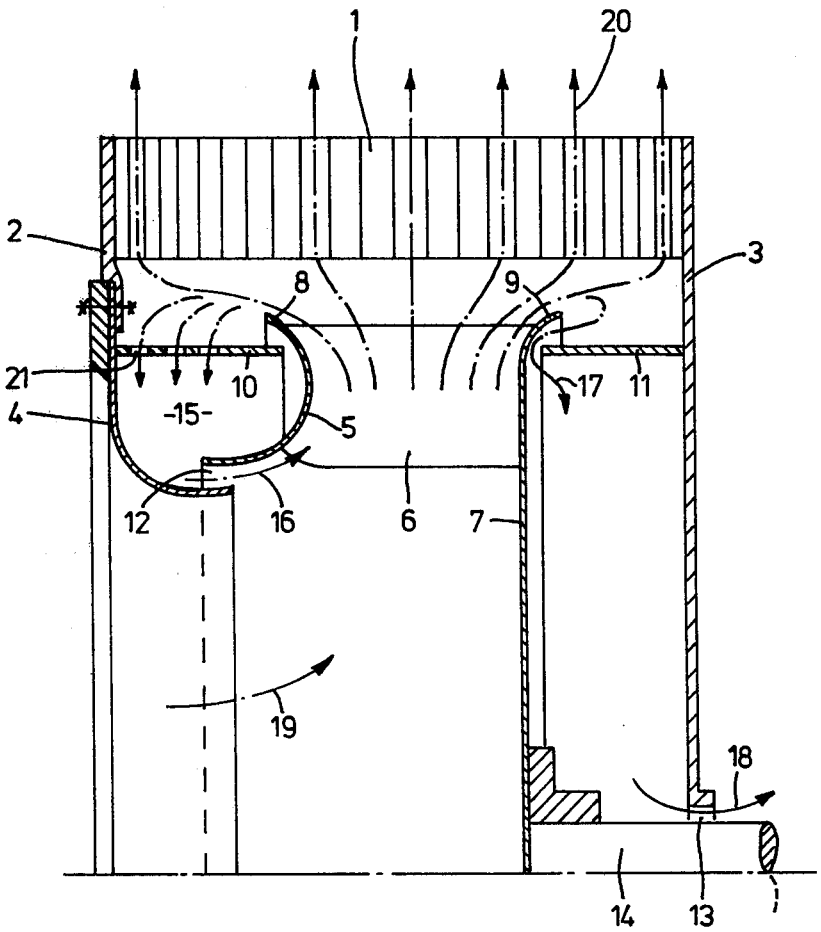
1
20
2
3
8
9
21
10
17
11
4
-15-
5
12
16
6
7
19
18
14
13

COOLING SYSTEM FOR INTERNAL COMBUSTION ENGINES

FIELD OF THE INVENTION

The invention relates to cooling systems for internal combustion engines for use in motor vehicles in heavy duty service. More particularly, the invention relates to a heavy duty cooling system including an annular radiator and an associated, coaxial centrifugal fan.

BACKGROUND OF THE INVENTION AND PRIOR ART

Heavy duty cooling systems of the type identified above are known, for example, for use in armored vehicles, heavy trucks and the like, and are described, for example, by the German published applications Nos. 2 435 839, 2 462 475 and the German laid-open application OS No. 2 050 265.

Cooling systems employing centrifugal fans are also envisioned for use in passenger cars and trucks in order to provide adequate cooling with reduced noise generation as may be required in the future on the basis of anticipated regulations regarding noise generation. The specific noise level due to a centrifugal fan is at least 6 dB below that attainable by an axial fan of equal performance.

In the customary configuration of centrifugal fan cooling systems, the fan is located at the center of an annular radiator. Air is aspirated axially and is discharged from the fan in a generally radial or radial/tangential direction for passage through the radiator cooling fins. In order to obtain the necessary cooling capacity, it is normally required to construct the cooler, i.e., radiator, with a greater axial length than the axial width of the air outlet orifice of the concentric centrifugal fan. This discrepancy is due to the fact that the maximum axial length of the fan blades is determined by the maximum permissible delay occurring between the passage of air through the narrowest cross section of the inlet aperture and the inlet area of the fan blades. This delay must not exceed a given limit beyond which there would occur a flow separation within the fan wheel. Accordingly, the fan wheel outlet axial length cannot generally be made equal to the axial length of the annular radiator.

For example, in known cooling systems of this type of construction, the ratio of the radiator axial length to the axial length of the blower outlet orifice is approximately 2.0–3.3 (see for example U.S. Pat. No. 3,698,473 or the German patent No. PS 1 576 705). Furthermore, the radial distance between the air outlet of the fan and the inlet of the radiator must be kept relatively small so as to save space. Accordingly, the air flow is concentrated in the middle of the radiator, i.e., in the general vicinity of the blower outlet but is substantially reduced in the lateral regions of the annular radiator.

In order to overcome this disadvantage, it has been proposed to dispose conical guide rings between the fan and the radiator, for example as described in the U.S. Pat. No. 3,698,473 or the German Pat. No. 1 576 705, as well as in the German laid-open application No. 2 050 265. This construction defines a number of radial diffusors which generally enlarge the blower outlet orifice to the axial length of the cooler inlet side. However, this construction is very complicated and expensive.

It has further been proposed in the German published application No. 2 462 475 to set a given ratio of blower axial length to radiator axial length as well as a ratio of blower diameter to radiator diameter so as to optimize the velocity distribution of the air within the radiator. However, measurements made on cooling systems which obey these conditions have shown that the results are still less than satisfactory.

OBJECTS AND GENERAL DESCRIPTION OF THE INVENTION

It is thus a principal object of the present invention to provide a cooling system for an internal combustion engine of the type in which an annular radiator is associated with a centrifugal fan, in which the overall radial dimensions of the entire system are small and the distance between the outer extent of the fan wheel and the inlet of the annular radiator is also small, while, at the same time, providing a substantial improvement of the uniformity of air flow through the annular radiator by comparison with any system known in the prior art.

This object is attained according to the invention by providing an annular radiator with an internal coaxial centrifugal fan in which at least one and possibly both of the fan wheel discs are provided with peripheral features of generally rounded shape that tend to enlarge the blower outlet cross section. This construction causes a lateral deflection of the air flow well within the radial blades of the fan wheel so that the lateral regions of the annular cooler receive substantially greater air flow than would otherwise be the case. The construction according to the invention defines a short diffusor of high efficiency and virtually without flow separation. This favorable result is due to the fact that the rotation of the fan wheel discs causes centrifugal removal of the boundary layer from the walls. A further feature of the invention is the creation of a velocity pressure head due to the presence of the radiator which has a favorable effect on the delay of the air flow.

A rounded construction of the fixed housing of a cooling system between the cover plates of the fan wheel and the radiator has been described in the German laid-open application No. 22 35 729 to provide a flow deviation of almost 90°. However, in this known construction, principally for the use in armored vehicles where a low vertical silhouette is required, the radiator inlet surface is substantially parallel to the exit air flow from the fan wheel so that the construction disclosed there is not directly applicable to the cooling system in which the radial blower is located at the hollow center of an annular radiator.

In a preferred embodiment of the invention, the rounded air guide features of the fan wheel cover plate and/or the fan wheel base begin in the region of the fan wheel blades.

A further improvement, especially of the air flow in the lateral radiator region lying on the air inlet side of the system, is obtained by the disposition of a baffle ring coaxial with the remaining system and attached by one edge to the frontal plate of the annular radiator.

This baffle ring tends to create a velocity head in the lateral regions of the radiator and improves the air inlet conditions at the lateral regions of the radiator while at the same time reducing the air gap losses in the blower. This is particularly useful because, in general practice, the surfaces of the air inlet nozzle and the cover plate are not machined so that it is necessary to provide a gap of at least four millimeters to prevent mechanical interference.

The baffle ring according to the invention provides considerable improvement, especially in those cases in which the centrifugal fan wheel is mounted on a shaft end, for example the crankshaft end of an internal combustion engine, whereas the annular radiator is attached to the vehicle frame. The resulting relative movement as between the blower shaft and the radiator axis requires clearance gaps of up to 25 mm which normally results in substantial performance losses. The baffle ring according to the invention sharply diminishes the air flow through the gap and thus increases the efficiency and air capacity of the combined system.

In high-efficiency centrifugal fan systems which must be used if it is required to operate with relatively low noise, a precondition is a uniform and vortex-free flow within the gap so as to prevent air flow separation and the baffle ring must be adapted to these requirements. It has been found particularly favorable and it is a further feature of the invention to provide a baffle ring which has openings over at least a portion of its axial extent, permitting a throttled but uniform air flow through the gap between the fan wheel and the stationary parts of the inlet nozzle.

In still another favorable feature of the invention, there is disposed a second baffle ring at the rear portion of the system, generally located between the rear fan disc and the rear wall of the housing to which it may be attached. The second baffle ring also reduces the gap flow losses in the vicinity of the drive shaft of the fan wheel.

Still other characteristics and advantages of the invention will emerge from the following detailed description of a preferred exemplary embodiment which relates to the drawing.

In general, the invention involves a cooling system for an internal combustion engine comprising a centrifugal fan and an annular radiator disposed thereabout whereby air is received axially by the centrifugal fan and blown generally radially therefrom to the annular radiator, and wherein the centrifugal fan comprises a pair of fan wheel discs which define the axial length of the centrifugal fan, and further wherein the axial length of the annular radiator is approximately 2–3.3 times the axial length of the centrifugal fan, the improvement wherein the peripheral edges of the fan wheel discs are curved away from one another to define an enlarged air exit orifice cross section.

BRIEF DESCRIPTION OF THE DRAWING

The single FIGURE of the drawing is a sectional side view of one-half of a cooling system according to the invention, the other half being mirror-symmetric therewith.

DESCRIPTION OF THE PREFERRED EMBODIMENT

The cooling system according to the invention includes as a principal element an annular radiator 1 attached between a front wall 2 and a rear wall 3. Located within the central open region of the annular radiator 1 is a centrifugal fan including a fan wheel composed of a rotating frontal plate or fan wheel disc 5, a rotating rear plate or fan wheel disc 7 and a plurality of fan blades 6 disposed therebetween, and which centrifugal fan 6 rotates on an axle 14. According to the present invention, one or both of the fan wheel discs 5 and 7 exhibits a generally rounded periphery 8 and 9, respectively, which tend to guide the radially emerging air flow aspirated in the direction of the arrow 19 out of the fan in the direction of the arrows 20.

Connected to the stationary front wall is an annular curved plate 4 and an annular baffle plate 21. A clearance gap 12 is provided between the rotating fan wheel disc 5 and curved stationary plate 4.

The normal air flow tends to be short-circuited in the lateral regions of the radiator 1 to return into the vicinity of the fan wheel through the aforementioned clearance gap 12. This short-circuit current 15 is made uniform by the presence of the frontal baffle ring 10, especially due to the presence of the openings 21. The air emerges from the frontal gap 12 as a return current 16.

Similarly, the leakage air flow 17 through the rear clearance gap is advantageously guided and diminished by the presence of a rear baffle ring 11. The leakage flow 17 passes along the rear wall and emerges through the clearance gap 13 as a leakage current 18.

It is a conspicuous feature of the present invention that the rounded peripheral feature 8 and/or 9 originate well within the radial extent of the fan blades 6. This fact results in an air flow pattern 20 which is substantially uniform over its entire axial extent.

The foregoing example illustrated in the drawing is understood however to be merely exemplary. The invention is not limited thereto but includes instead any modifications or changes which would be within the competence of a person skilled in the art. Furthermore, any characteristics of the illustrated embodiment can be used alone or in combination without exceeding the scope of the invention.

An annular radiator which may be employed in practicing the present invention may be of other than circular construction. For example, it may be constructed of a number of separate segments which are assembled around the centrifugal fan in one of a number of suitable shapes, for example, oval, elliptical, partially circular and others.

I claim:

1. In a cooling system for an internal combustion engine comprising a centrifugal fan and an annular radiator disposed thereabout whereby air is received axially by said centrifugal fan and blown generally radially therefrom to said annular radiator, said centrifugal fan comprising a pair of rotatable fan wheel discs which define the axial length of said centrifugal fan, and wherein the axial length of said annular radiator is approximately 2–3.3 times the axial length of said centrifugal fan, the improvement wherein the peripheral edges of said fan wheel discs are rounded and curved away from one another to define an enlarged air exit orifice cross section, wherein said annular radiator is attached between a front wall and a rear wall, said cooling system further comprising an annular baffle ring attached to said front wall and extending axially toward, and terminating close to, the one of said pair of rotatable fan wheel discs which is closest thereto.

2. A cooling system according to claim 1, wherein at least a portion of the axial extent of said baffle ring has openings permitting air flow therethrough.

3. In a cooling system for an internal combustion engine comprising a centrifugal fan and an annular radiator disposed thereabout whereby air is received axially by said centrifugal fan and blown generally radially therefrom to said annular radiator, said centrifugal fan comprising a pair of rotatable fan wheel discs which extend substantially at right angles to the axis of said fan and very close to the edges of said discs, and which discs define the axial length of said centrifugal fan, and wherein the axial length of said annular radiator is approximately 2–3.3 times the axial length of said centrifugal fan, the improvement wherein the peripheral edges of said fan wheel discs are rounded and curved away from one another to define an enlarged air exit orifice cross section, and said annular radiator is closely spaced from said peripheral edges of said discs so as to define only a small annular gap therebetween.

4. A cooling system according to claim 3, wherein a plurality of fan blades extend between said fan wheel discs, and said peripheral rounded curved edges begin to curve within the radial extent of the fan blades.

5. A cooling system according to claim 3, wherein the radius of curvature of each said curved edge of each said fan wheel disc is less than the axial length of said centrifugal fan.

6. A cooling system according to claims 3 or 1, wherein said annular radiator is attached between a front wall and a rear wall, said cooling system further comprising an annular baffle ring attached to said rear wall and extending axially toward, and terminating close to, the one of said pair of rotatable fan wheel discs which is closest thereto.

* * * * *